US011451894B2

(12) United States Patent
Lin

(10) Patent No.: US 11,451,894 B2
(45) Date of Patent: Sep. 20, 2022

(54) EAR CUP STRUCTURE

(71) Applicant: Merry Electronics(Shenzhen) Co., Ltd., ShenZhen (CN)

(72) Inventor: Chia-Chung Lin, Taichung (TW)

(73) Assignee: Merry Electronics(Shenzhen) Co., Ltd., ShenZhen (CN)

( * ) Notice: Subject to any disclaimer, the term of this patent is extended or adjusted under 35 U.S.C. 154(b) by 18 days.

(21) Appl. No.: 16/742,833

(22) Filed: Jan. 14, 2020

(65) Prior Publication Data

US 2021/0099784 A1 Apr. 1, 2021

(30) Foreign Application Priority Data

Sep. 26, 2019 (TW) ..... 108134849

(51) Int. Cl.
*H04R 25/00* (2006.01)
*H04R 1/10* (2006.01)
*H04R 1/34* (2006.01)

(52) U.S. Cl.
CPC ..... *H04R 1/1008* (2013.01); *H04R 1/1075* (2013.01); *H04R 1/345* (2013.01); *H04R 2460/11* (2013.01)

(58) Field of Classification Search
CPC .... H04R 1/1008; H04R 1/1075; H04R 1/345; H04R 2460/11
USPC ..... 381/371
See application file for complete search history.

(56) References Cited

U.S. PATENT DOCUMENTS

2017/0006373 A1* 1/2017 Bruss ..... H04R 1/2826

* cited by examiner

*Primary Examiner* — Phylesha Dabney
(74) *Attorney, Agent, or Firm* — JCIPRNET

(57) ABSTRACT

An ear cup structure including an ear cup shell, a cover, a discharge hole, a speaker, and a guide channel is provided. The ear cup shell has at least a first accommodating space and a second accommodating space spaced from each other, and the second accommodating space has a second opening. The cover covers the second opening of the second accommodating space. The discharge hole is formed between the ear cup shell and the cover. The speaker is disposed in the second accommodating space, thereby dividing the second accommodating space into a front chamber and a rear chamber. The guide channel is communicated with a peripheral side of the rear chamber and is disposed between the rear chamber and the discharge hole. An airflow produced by the speaker in the rear chamber flows through the guide channel and is discharged to an external environment from the discharge hole.

11 Claims, 5 Drawing Sheets

EAR CUP STRUCTURE

CROSS-REFERENCE TO RELATED APPLICATION

This application claims the priority benefit of Taiwan application serial no. 108134849, filed on Sep. 26, 2019. The entirety of the above-mentioned patent application is hereby incorporated by reference herein and made a part of this specification.

BACKGROUND

Technical Field

The disclosure relates to an ear cup structure, and more particularly to an ear cup structure adapted to mediate air pressure in a chamber to adjust acoustic resistance.

Description of Related Art

A conventional ear cup type earphone has left and right ear cup shells, but the left and right ear cup shells may have different numbers of opening holes in them due to different designs of buttons or other terminals, so the left and right ear cup shells may have different air discharge amounts, which will cause differences in the resonance frequency and the ventilation amount between the left and right ear cups, and the sound quality and curve of the left and right sound channels will thus be different.

Therefore, in view of the problems existing in the above-mentioned conventional ear cup shells, how to develop ear cups that can improve the difference in discharge amounts between left and right ear cups has been the goal and direction of the breakthrough of research and development for related industries.

SUMMARY

The disclosure provides an ear cup structure which is an ear cup structure adapted to mediate internal air pressure to adjust acoustic resistance and can improve the problem of differences in airflow discharge amounts of the ear cup structure.

An ear cup structure of the disclosure includes an ear cup shell, a cover, a discharge hole, a speaker and a guide channel. The ear cup shell has at least a first accommodating space and a second accommodating space spaced from each other, and the second accommodating space has a second opening. The cover covers the second opening of the second accommodating space. The discharge hole is formed between the ear cup shell and the cover. The speaker is disposed in the second accommodating space, thereby dividing the second accommodating space into a front chamber and a rear chamber. The guide channel is communicated with a peripheral side of the rear chamber and is disposed between the rear chamber and the discharge hole, wherein an airflow produced by the speaker in the rear chamber flows through the guide channel and is discharged to an external environment from the discharge hole.

In an embodiment of the disclosure, the ear cup shell includes an outer shell and a partition shell; the outer shell is in the form of a basin-shaped shell and is formed with a peripheral side wall, a top wall, and a first opening with respect to the top wall; the peripheral side wall and the top wall together form the first accommodating space; the partition shell has a concave shape in the middle and forms the second accommodating space and a bulging edge portion extending from the second accommodating space toward a peripheral side; and the partition shell seals the first opening of the outer shell.

In an embodiment of the disclosure, the ear cup structure includes a guide channel, and the guide channel is formed by the bulging edge portion of the partition shell and the cover in a spaced configuration.

In an embodiment of the disclosure, the guide channel is formed with a letting groove.

In an embodiment of the disclosure, the guide channel is formed in a radial direction of the speaker.

In an embodiment of the disclosure, the ear cup structure includes a plurality of support ribs, and the plurality of support ribs are formed between the bulging edge portion of the partition shell and the cover and surround the second accommodating space at a plurality of intervals.

In an embodiment of the disclosure, an ear cup is further included, and the ear cup is disposed between the cover and the ear cup shell, and the ear cup and a bottom surface of the cover form a sound output channel.

In an embodiment of the disclosure, the bulging edge portion of the partition shell is formed with a plurality of diagonal ribs extending toward the cover.

In an embodiment of the disclosure, the cover has a plurality of sound transmission holes, and the sound output channel is communicated with the front chamber through the plurality of sound transmission holes.

In an embodiment of the disclosure, the cover has at least one pressure relief hole communicated with the guide channel.

In an embodiment of the disclosure, an outer edge of the bulging edge portion of the partition shell is formed with a strengthening edge that is bonded to the peripheral side wall of the outer shell.

In an embodiment of the disclosure, a tuning portion is formed between the rear chamber and the guide channel, and the tuning portion includes a side wall and at least one through hole formed in the side wall.

Based on the above, the ear cup structure of the disclosure has the discharge hole and the guide channel between the ear cup shell and the cover. The airflow produced by the speaker in the rear chamber flows through the guide channel and is discharged to the external environment from the discharge hole for balancing the air pressure in the rear chamber. The ear cup structure of the disclosure can improve the problem of differences in airflow discharge amounts of the ear cup structure.

In addition, changing the length of the guide channel can also adjust the acoustic resistance of the ear cup structure, thereby adjusting the characteristics of the sound curve, audio frequency, sound quality and the like exhibited by the speaker.

In order to make the aforementioned features and advantages of the disclosure comprehensible, embodiments accompanied with drawings are described in detail below.

DESCRIPTION OF THE EMBODIMENTS

Figure 1A:
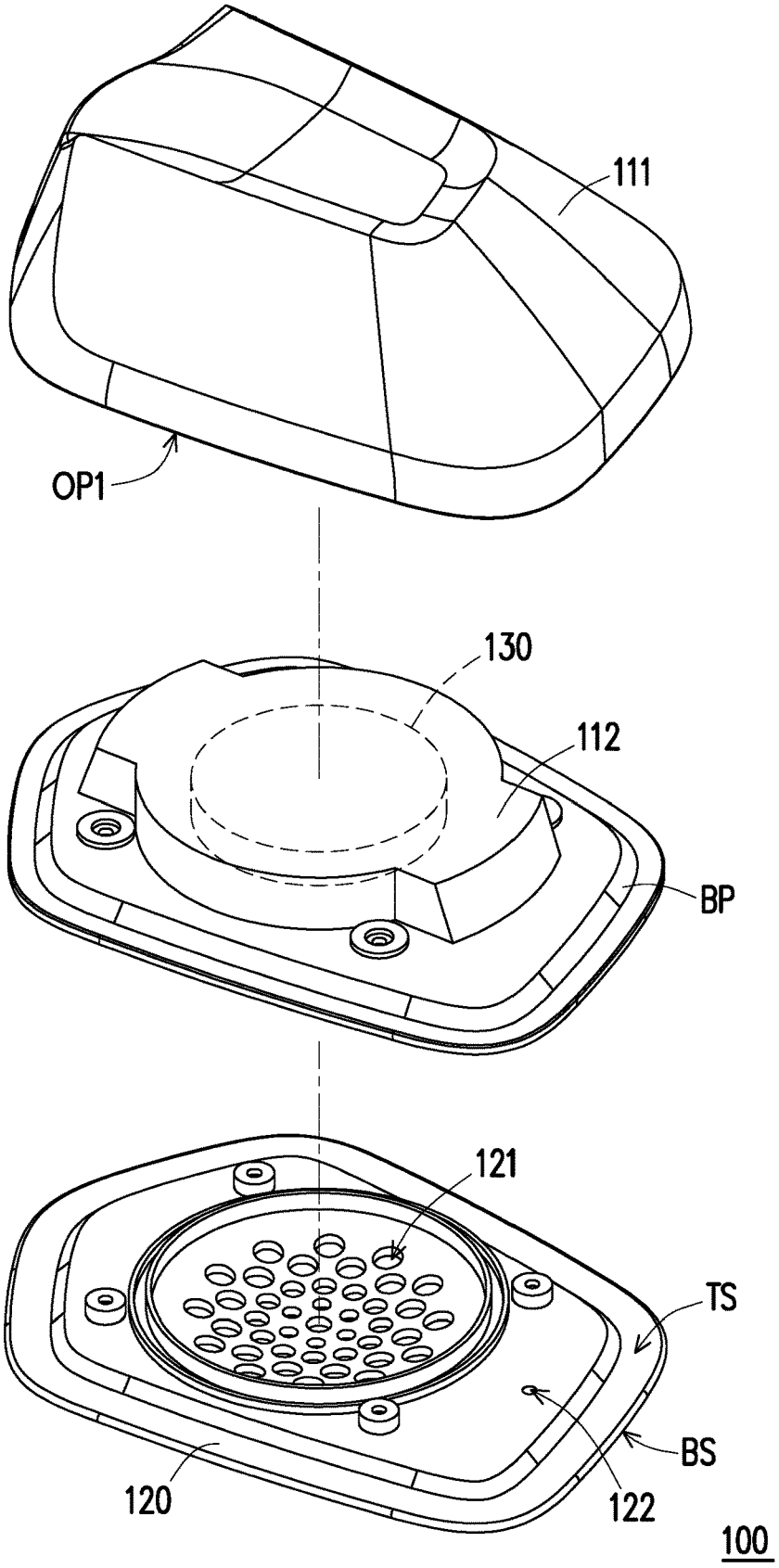
FIG. 1A is a schematic exploded perspective view of an ear cup structure according to an embodiment of the disclosure.
Figure 1B:
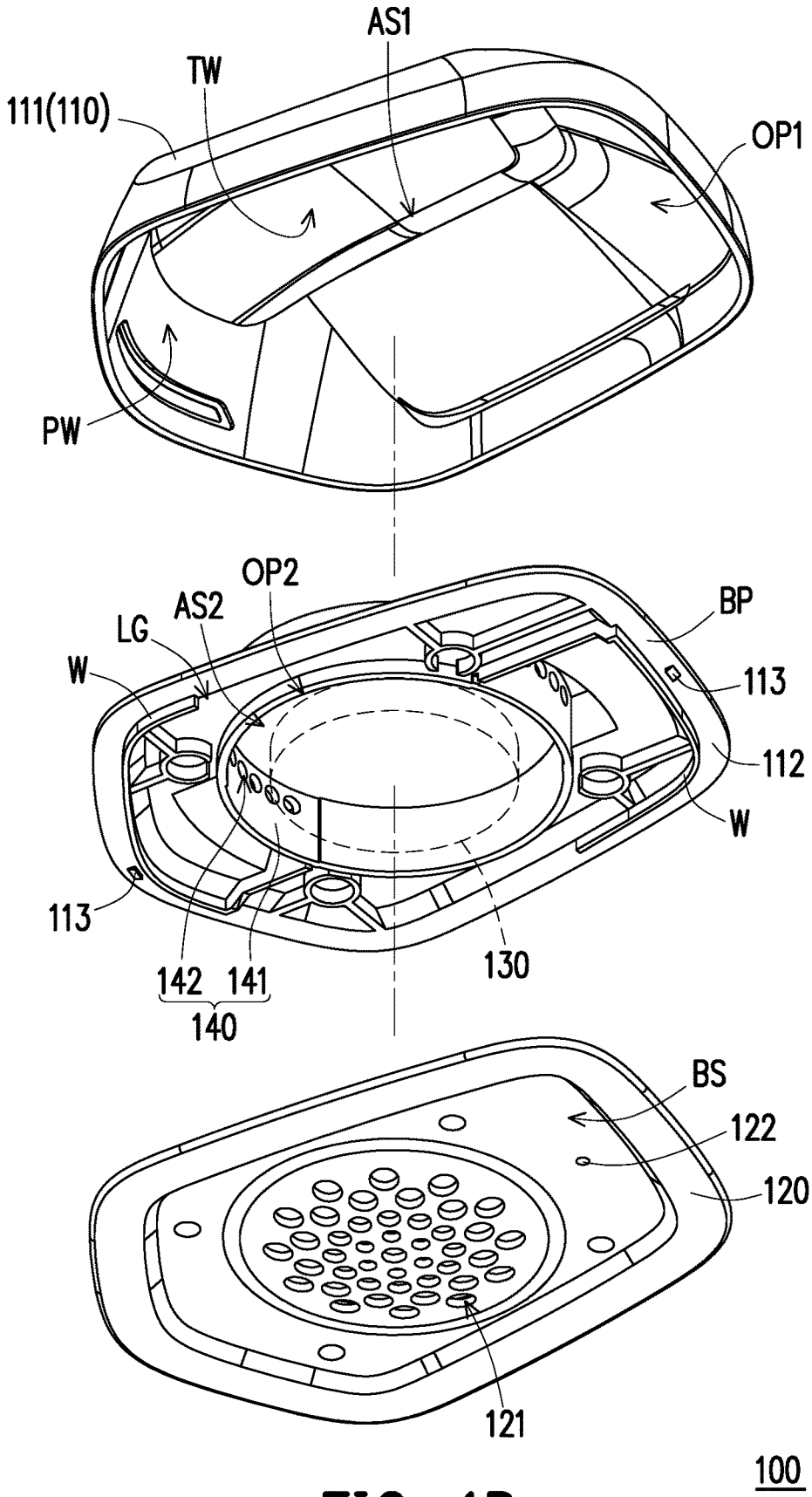
FIG. 1B is a schematic exploded perspective view of the ear cup structure of FIG. 1A from another perspective.
Figure 2:
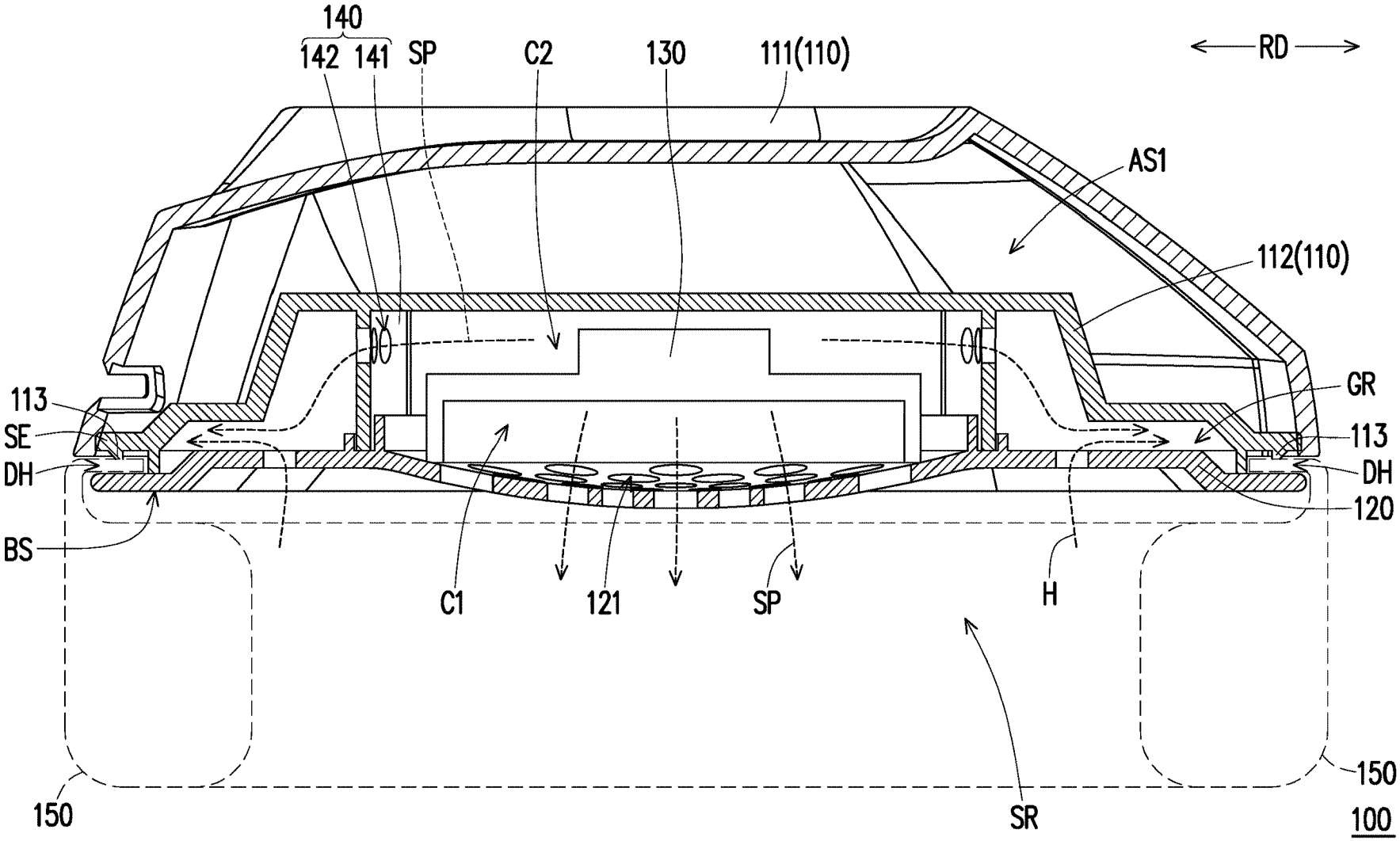
FIG. 2 is a schematic front cross-sectional view of the ear cup structure of FIG. 1A.

Referring to FIGS. 1A, 1B, and 2, an ear cup structure 100 of the disclosure is applied to an ear cup type earphone. The ear cup type earphone has a headband and two ear cup structures 100. The headband is made of an elastic material and is worn on the top of a user's head, and the two ear cup structures 100 respectively abut against the user's ears.

Referring to FIGS. 1A to 2, the ear cup structure 100 of the disclosure includes an ear cup shell 110, a cover 120, a discharge hole DH, a speaker 130, a guide channel GR, and a tuning portion 140.

The ear cup shell 110 has a first accommodating space AS1 and a second accommodating space AS2. The second accommodating space AS2 has a second opening OP2. The first accommodating space AS1 and the second accommodating space AS2 are not in communication with each other.

In detail, the ear cup shell 110 includes an outer shell 111 and a partition shell 112. The outer shell 111 is in the form of a basin-shaped shell and is formed with a peripheral side wall PW, a top wall TW, and a first opening OP1 with respect to the top wall TW. The top wall TW and the peripheral side wall PW are, for example, integrally formed, and the peripheral side wall PW and the top wall TW together form the first accommodating space AS1.

The partition shell 112 has a concave shape in the middle, and forms the second accommodating space AS2 and a bulging edge portion BP extending from the second accommodating space AS2 toward the peripheral side, wherein the bulging edge portion BP of the partition shell 112 seals the first opening OP1 of the outer shell 111.

The cover 120 covers at least the second opening OP2 of the second accommodating space AS2 of the partition shell 112.

Referring to FIG. 2, the speaker 130 is disposed in the second accommodating space AS2 of the ear cup shell 110, thereby dividing the second accommodating space AS2 of the partition shell 112 into a front chamber C1 and a rear chamber C2.

The tuning portion 140 is formed in the second accommodating space AS2 of the ear cup shell 110. The tuning portion 140 is adapted to be communicated with the rear chamber C2 and an external environment. The tuning portion 140 is configured to guide air in the rear chamber C2 for adjusting acoustic resistance, so that the characteristics of the sound curve, audio frequency, sound quality and the like output by the speaker 130 can meet the design requirements.

Referring to FIG. 2, the ear cup structure 100 includes the guide channel GR. The guide channel GR is formed by the bulging edge portion BP of the partition shell 112 and the cover 120 in a spaced configuration, and the tuning portion 140 includes a side wall 141 and at least one through hole 142 formed in the side wall 141 (in this embodiment, the tuning portion 140 includes a plurality of through holes 142). The plurality of through holes 142 of the tuning portion 140 are communicated with the rear chamber C2 and the guide channel GR. An airflow produced by the speaker 130 in the rear chamber C2 flows through the through holes 142 of the tuning portion 140 and the guide channel GR and is discharged to the external environment from the discharge hole DH.

In detail, two ends of the guide channel GR are respectively communicated with the tuning portion 140 and the external environment. The guide channel GR is formed in a radial direction RD of the speaker 130, and the air produced by the speaker 130 in the second accommodating space AS2 is discharged from the discharge hole DH on the peripheral side of the ear cup shell 110 to the external environment along the guide channel GR, in order to meet the tuning needs and to balance the air pressure in the rear chamber C2.

Referring to FIGS. 1A, 1B, and 2, the partition shell 112 includes a plurality of retaining walls W formed at a bottom of the bulging edge portion BP of the partition shell 112 and abutting against a top surface TS of the cover 120.

The ear cup structure 100 further includes an ear cup 150 disposed on the top surface TS of the cover 120, and the bulging edge portion BP of the partition shell 112 is formed with a plurality of diagonal ribs 113. The plurality of diagonal ribs 113 extend toward the top surface TS of the cover 120 and abut against the ear cup 150 attached to the top surface TS for assisting in fixing the ear cup 150.

Referring to FIG. 2, the cover 120 has a plurality of sound transmission holes 121, and most of the sound waves SP produced by the speaker 130 pass through the plurality of sound transmission holes 121 from the front chamber C1 into a sound output channel SR, and are output from the sound output channel SR and propagated into the user's ear, wherein the ear cup 150 and a bottom surface BS of the cover 120 form the sound output channel SR.

Further, the cover 120 has at least one pressure relief hole 122 penetrating through the cover 120 to be communicated with the guide channel GR, so that part of the air located in the sound output channel SR may also be discharged to the external environment through the at least one pressure relief hole 122. The reason is that the ear cup 150 and the sound output channel SR are sealed from the user's ear, which is not advantageous for achieving the balance of the internal and external air pressure.

In other embodiments, a plurality of mesh members are further included and respectively disposed on the plurality of through holes 142 of the tuning portion 140 for changing the wave velocity of the sound waves SP of the speaker 130 passing through the through holes 142, thereby achieving the purpose of adjusting the acoustic resistance of the earphone.

Figure 3A:
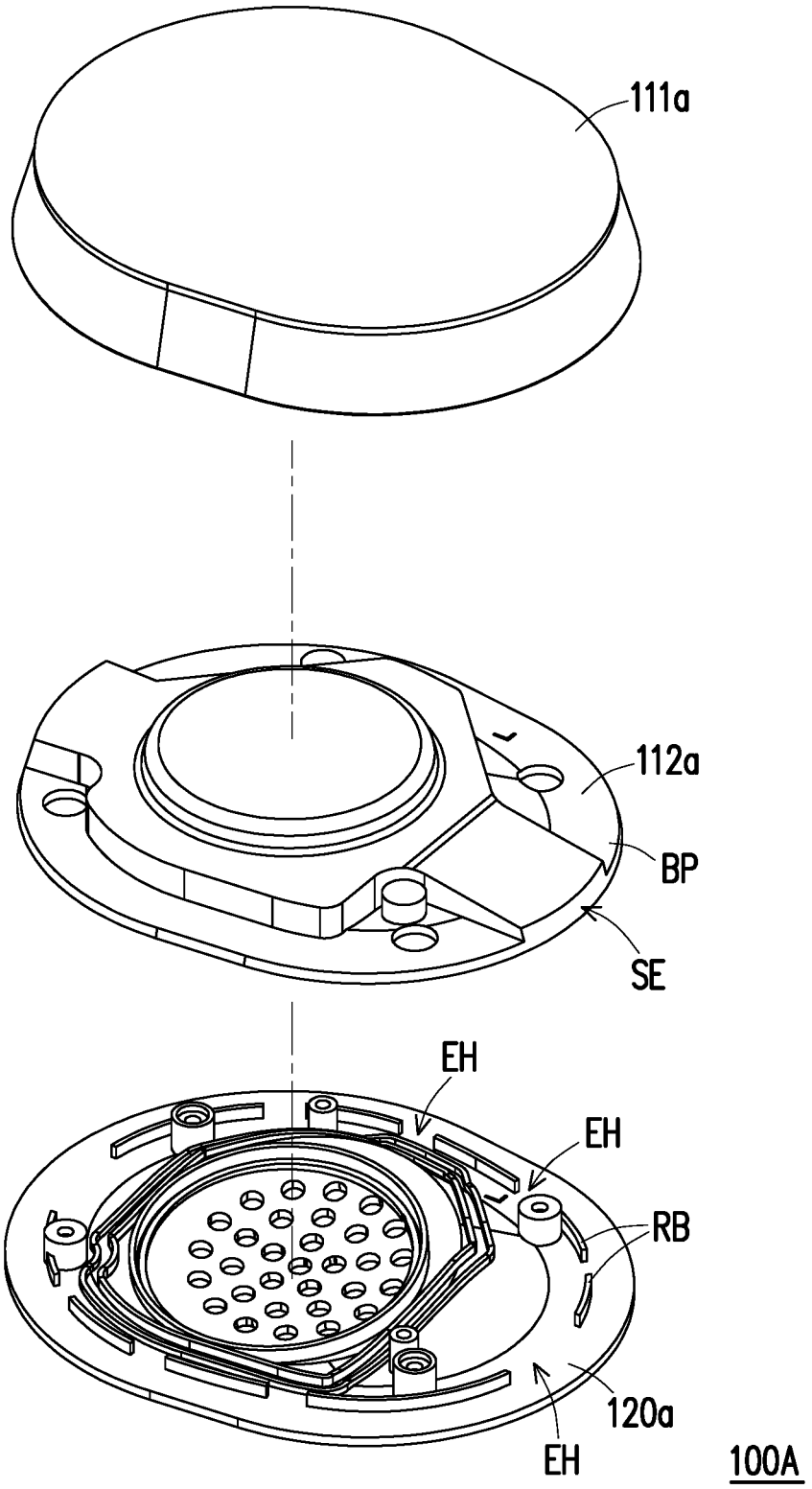
FIG. 3A is a schematic exploded perspective view of an ear cup structure according to another embodiment of the disclosure.
Figure 3B:
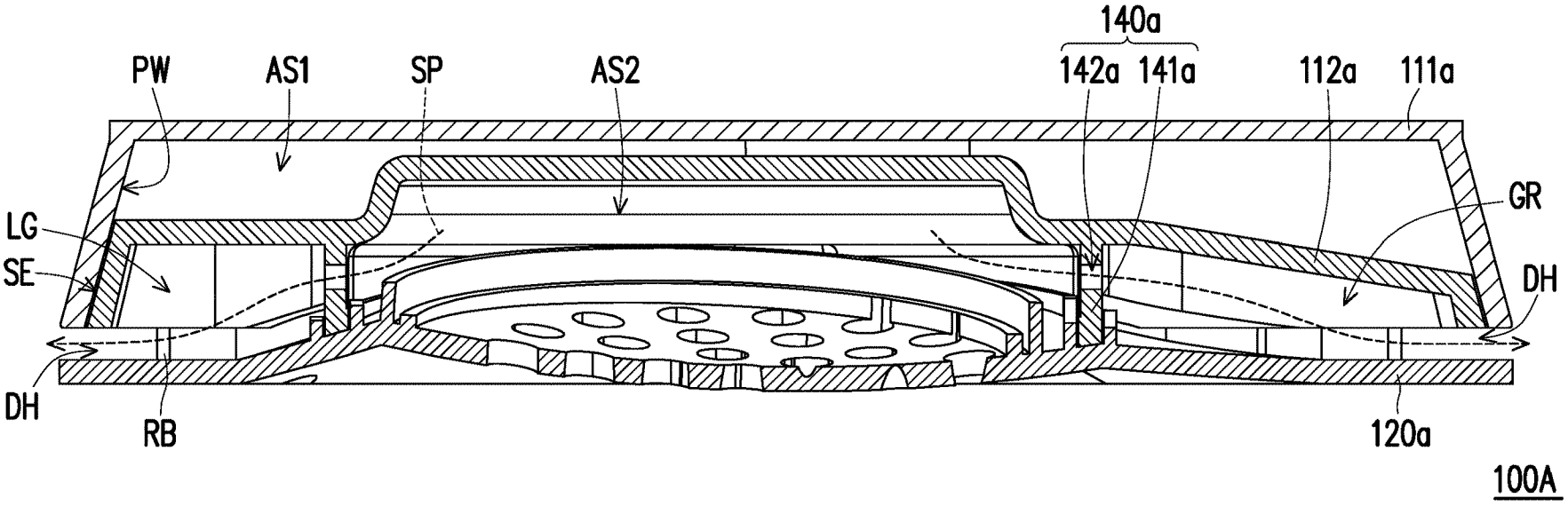
FIG. 3B is a schematic front cross-sectional view of the ear cup structure of FIG. 3A.

FIG. 3A is a schematic exploded perspective view of an ear cup structure according to another embodiment of the disclosure. FIG. 3B is a schematic front cross-sectional view of the ear cup structure of FIG. 3A.

Referring to FIGS. 3A and 3B, the ear cup structure 100A of the present embodiment is similar to the ear cup structure 100 shown in FIG. 1A. The difference is that the ear cup structure 100A includes a plurality of support ribs RB. The plurality of support ribs RB are formed between the bulging edge portion BP of the partition shell 112*a* and the cover 120*a*, and surround the second accommodating space AS2 at a plurality of intervals. In detail, the plurality of support ribs RB are spaced apart from each other to form a plurality of exhaust holes EH of the guide channel GR. In short, the sound waves SP and the air in the second accommodating space AS2 pass through the plurality of through holes 142*a* of the tuning portion 140*a*, and flow into the guide channel GR located between the cover 120*a* and the partition shell 112*a*, and in the end are transmitted to the external environment through the plurality of exhaust holes EH. In addition, an outer edge of the bulging edge portion BP of the partition shell 112*a* of the embodiment is formed with a strengthening edge SE that is bonded to the peripheral side wall PW of the outer shell 111*a*, so that the air flowing through the guide channel GR is transmitted to the external environment along the strengthening edge SE and is prevented from flowing back into the first accommodating space AS1, and the guide channel GR is formed with a letting groove LG.

In summary, the ear cup structure of the disclosure has the discharge hole and the guide channel between the ear cup shell and the cover. The airflow produced by the speaker in the rear chamber flows through the guide channel and is discharged to the external environment from the discharge hole for balancing the air pressure in the rear chamber. The ear cup structure of the disclosure can improve the problem of differences in airflow discharge amounts of the ear cup structure.

In addition, changing the length of the guide channel can also adjust the acoustic resistance of the ear cup structure, thereby adjusting the characteristics of the sound curve, audio frequency, sound quality and the like exhibited by the speaker.

Although the disclosure has been described with reference to the above embodiments, they are not intended to limit the disclosure. It will be apparent to one of ordinary skill in the art that modifications to the described embodiments may be made without departing from the spirit and the scope of the disclosure. Accordingly, the scope of the disclosure will be defined by the attached claims and their equivalents and not by the above detailed descriptions.

What is claimed is:

1. An ear cup structure, comprising:

an ear cup shell having at least a first accommodating space and a second accommodating space spaced from each other, the second accommodating space having a second opening;

a cover covering the second opening of the second accommodating space;

a discharge hole formed between the ear cup shell and the cover;

a speaker disposed in the second accommodating space, thereby dividing the second accommodating space into a front chamber and a rear chamber, and having a central axis; and a guide channel communicated with a peripheral side of the rear chamber and disposed between the rear chamber and the discharge hole, wherein the guide channel is formed in a radial direction of the speaker, and the discharge hole communicated with the guide channel is formed in the radial direction of the central axis of the speaker, wherein an airflow produced by the speaker in the rear chamber flows through the guide channel and is discharged to an external environment from the discharge hole, and a direction of the airflow flowing to the discharge hole is not parallel to an axial direction of the central axis of the speaker, wherein the ear cup shell comprises a partition shell, the partition shell forms the second accommodating space and a bulging edge portion extending from the second accommodating space toward a peripheral side, and wherein the guide channel is formed by the bulging edge portion of the partition shell and the cover in a spaced configuration.

2. The ear cup structure according to claim 1, wherein the ear cup shell comprises an outer shell, the outer shell is in the form of a basin-shaped shell and is formed with a peripheral side wall, a top wall, and a first opening with respect to the top wall, the peripheral side wall and the top wall together form the first accommodating space, the partition shell has a concave shape in the middle, and the partition shell seals the first opening of the outer shell.

3. The ear cup structure according to claim 2, wherein the bulging edge portion of the partition shell is formed with a plurality of diagonal ribs extending toward the cover.

4. The ear cup structure according to claim 2, wherein an outer edge of the bulging edge portion of the partition shell is formed with a strengthening edge that is bonded to the peripheral side wall of the outer shell.

5. The ear cup structure according to claim 1, wherein the guide channel is formed with a letting groove.

6. The ear cup structure according to claim 1, wherein the guide channel is formed in a radial direction of the speaker.

7. The ear cup structure according to claim 1, wherein the ear cup structure comprises a plurality of support ribs, the plurality of support ribs are formed between the bulging edge portion of the partition shell and the cover and surround the second accommodating space at a plurality of intervals.

8. The ear cup structure according to claim 1, further comprising an ear cup disposed between the cover and the ear cup shell, and the ear cup and a bottom surface of the cover form a sound output channel.

9. The ear cup structure according to claim 8, wherein the cover has a plurality of sound transmission holes, and the sound output channel is communicated with the front chamber through the plurality of sound transmission holes.

10. The ear cup structure according to claim 1, wherein the cover has at least one pressure relief hole communicated with the guide channel.

11. The ear cup structure according to claim 1, wherein a tuning portion is formed between the rear chamber and the guide channel, and the tuning portion comprises a side wall and at least one through hole formed in the side wall.

* * * * *